US009478912B1

(12) United States Patent
Zusman et al.

(10) Patent No.: US 9,478,912 B1
(45) Date of Patent: Oct. 25, 2016

(54) ELECTRICAL CONNECTOR AND MANUFACTURING METHOD WITH IMPROVES ON KEYED ELECTRICAL CONNECTORS

(71) Applicant: Vibration Measurement Solutions, Inc., Houston, TX (US)

(72) Inventors: George V. Zusman, Houston, TX (US); Val J. Pollak, Clarence, NY (US)

(73) Assignee: Vibration Measurement Solutions, Inc., Houston, TX (US)

( * ) Notice: Subject to any disclaimer, the term of this patent is extended or adjusted under 35 U.S.C. 154(b) by 0 days.

(21) Appl. No.: 14/725,772

(22) Filed: May 29, 2015

(51) Int. Cl.
*H01R 13/64* (2006.01)
*H01R 13/642* (2006.01)
*H01R 43/16* (2006.01)

(52) U.S. Cl.
CPC ..... *H01R 13/642* (2013.01); *H01R 43/16* (2013.01)

(58) Field of Classification Search
CPC ..... H01R 13/64; H01R 13/6456
USPC ..... 439/680, 681, 374
See application file for complete search history.

(56) References Cited

U.S. PATENT DOCUMENTS 4,303,221 A 12/1981 Gallusser et al.
4,764,129 A 8/1988 Jones et al.
4,801,277 A * 1/1989 Seilhan ..... H01R 13/64 439/597
6,808,428 B1 10/2004 Korsunsky et al.
7,134,911 B2 11/2006 Bernhart et al.
7,669,479 B2 * 3/2010 Kurtz ..... G01K 7/023 73/714
8,251,754 B2 * 8/2012 Tai ..... H01R 13/6456 439/681
8,968,036 B2 * 3/2015 Ledgerwood ..... H01R 13/641 439/677
2002/0146931 A1 * 10/2002 Richmond ..... H01R 13/6453 439/488
2007/0155237 A1 * 7/2007 Cairns ..... H01R 13/521 439/587
2008/0233773 A1 * 9/2008 Meleck ..... H01R 13/64 439/107
2010/0029113 A1 * 2/2010 Smith, III ..... H01R 4/625 439/271
2012/0196490 A1 * 8/2012 De Blieck ..... H01R 43/16 439/681
2012/0258638 A1 * 10/2012 Yamada ..... H01R 13/64 439/752.5
2013/0280950 A1 * 10/2013 Becavin ..... H01R 13/64 439/488
2015/0079850 A1 * 3/2015 Tao ..... H01R 13/24 439/680

* cited by examiner

*Primary Examiner* — Abdullah Riyami
*Assistant Examiner* — Thang Nguyen
(74) *Attorney, Agent, or Firm* — Walter W. Duft

(57) ABSTRACT

An electrical connector includes a machined metal contact housing having a contact housing cavity surrounded by a contact housing wall. Two or more electrical contacts are disposed within the contact housing cavity. A polarization alignment key is disposed on an inside surface of the contact housing wall. A key-retaining pocket on the contact housing intersects an inside surface of the contact housing wall to form a longitudinal slot opening between the key-retaining pocket and the contact housing cavity. The key is mounted on the contact housing by virtue of a portion thereof being disposed in the key-retaining pocket. The electrical connector may be manufactured by (1) machining the key-retaining pocket in a metal blank from which the contact housing will be formed, (2) machining the contact housing cavity in the blank so as to intersect the key-retaining pocket, (3) mounting the key, and (4) mounting the electrical contacts.

19 Claims, 6 Drawing Sheets

ELECTRICAL CONNECTOR AND MANUFACTURING METHOD WITH IMPROVES ON KEYED ELECTRICAL CONNECTORS

BACKGROUND

1. Field

The present disclosure relates to electrical connectors. More particularly, the disclosure is directed to electrical connectors that are keyed to ensure proper electrical polarization.

2. Description of the Prior Art

By way of background, an electrical connector conventionally includes a shaped contact housing and two or more pin contacts arranged within a central cavity of the contact housing. In a mating pair of electrical connectors, one connector functions as a plug while the other connector functions as a receptacle. To ensure proper electrical polarization, one connector may have a key that slides into a corresponding keyway on the other connector, such that the connectors can be mated in only one possible orientation. FIG. 1, depicting a male connector "A" and a female connector "B," is illustrative of this type of electrical connector pair arrangement.

In some electrical connectors having machined metal contact housings, the key is fabricated as a metal pin that is attached to the contact housing cavity's inside wall. FIG. 2, depicting the male connector "A" of FIG. 1, is illustrative. According to this key-attachment technique, the pin is spot-welded into position and then brazed around its entire periphery to permanently secure it. The joint is then annealed to relieve unwanted stresses introduced by the welding and brazing operations. This a fairly cumbersome and time consuming process due to the steps involved and because great care must taken to ensure accurate placement and alignment of the pin.

Applicant discloses herein an improved electrical connector and manufacturing method that improves on existing keyed electrical connectors and the fabrication thereof.

SUMMARY

In accordance with one aspect of the present disclosure, an electrical connector includes a machined metal contact housing having a contact housing cavity surrounded by a contact housing wall. Two or more electrical contacts are disposed in the contact housing cavity. A polarization alignment key is disposed on an inside surface of the contact housing wall. The key is operable to engage a polarization alignment keyway during mating of the electrical connector with a counterpart electrical connector to form an electrical connector pair. A key-retaining pocket on the contact housing intersects an inside surface of the contact housing wall to form a longitudinal slot opening between the key-retaining pocket and the contact housing cavity. The key is mounted on the contact housing wall by virtue of a portion thereof being disposed in the key-retaining pocket.

In accordance with another aspect of the present disclosure, a method for manufacturing the above-described electrical connector includes (1) machining the key-retaining pocket in a metal blank from which the contact housing will be formed, (2) machining the contact housing cavity in the blank so as to intersect the key-retaining pocket and form the longitudinal slot opening between the key-retaining pocket and the contact housing cavity, (3) forming the key so as to provide the key portion that is disposed in the key-retaining pocket, (4) mounting the key to the contact housing by pressing the aforesaid key portion into the key-retaining pocket, and (5) mounting the two or more electrical contacts in the contact housing cavity.

BRIEF DESCRIPTION OF THE DRAWINGS

The foregoing and other features and advantages will be apparent from the following more particular description of example embodiments, as illustrated in the accompanying Drawings, in which.

DETAILED DESCRIPTION OF EXAMPLE EMBODIMENTS

Figure 1:
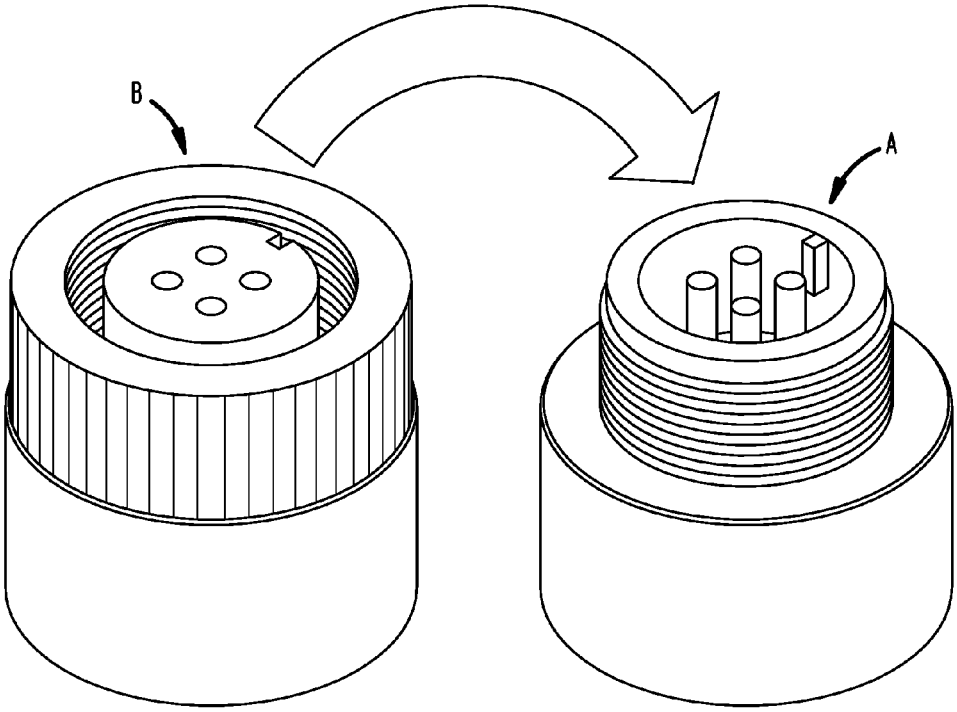
FIG. 1 (PRIOR ART)
FIG. 1 is a perspective view showing a pair of mating electrical connectors "A" and "B," with connector "B" having a keyway and connector "A" having a key mounted on the connector in accordance with a prior art mounting technique.
Figure 2:
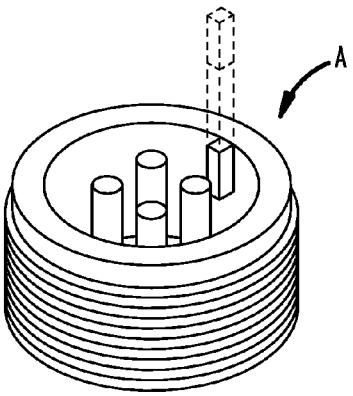
FIG. 2 (PRIOR ART)
FIG. 2 is a perspective view illustrating the key of connector "B" in FIG. 1, prior to and after it is mounted.
Figure 3:
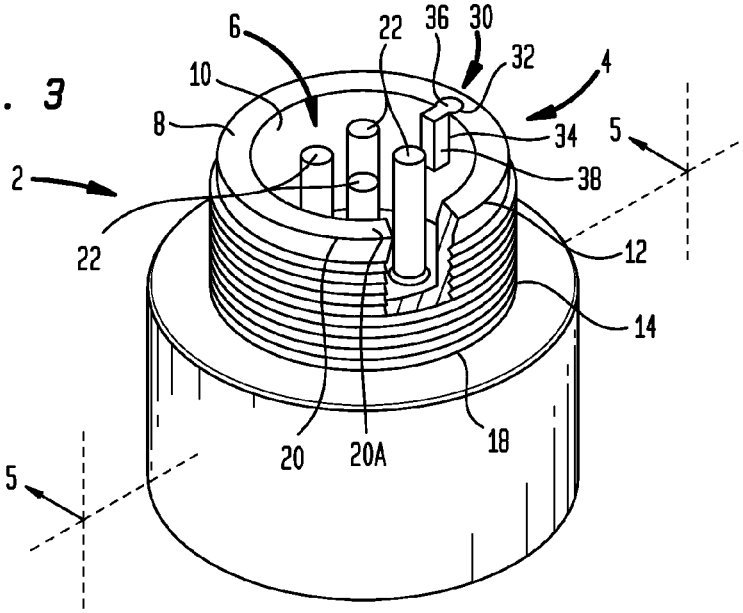
FIG. 3 is a perspective view showing an electrical connector having a key mounted on the connector in accordance with the present disclosure.
Figure 4:
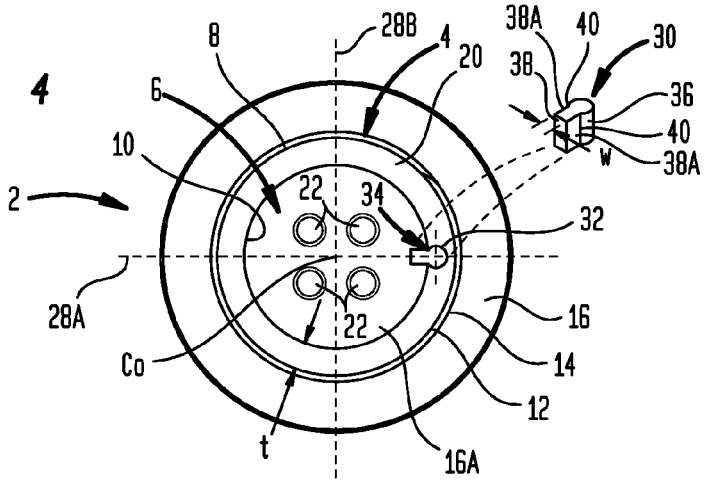
FIG. 4 is a top plan view of the electrical connector shown in FIG. 3.
Figure 5:
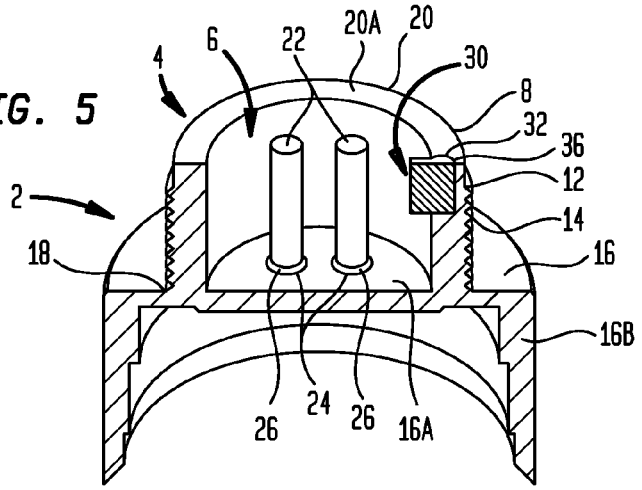
FIG. 5 is a cross-sectional view taken along line 5-5 in FIG. 3.

Turning now to the drawing figures, which are not necessarily to scale, like reference numbers will be used to represent like elements in all of the several views. FIGS. 3-5 illustrate an electrical connector 2 constructed according to one possible embodiment of the disclosed subject matter. The electrical connector 2 has an example configuration that allows it to serve as a replacement for the prior art electrical connector "A" shown on the right side of FIG. 1. The electrical connector 2 is adapted for mating with a counterpart electrical connector, such as the connector "B" shown on the left side of FIG. 1, to form an electrical connector pair.

The electrical connector 2 includes a machined metal contact housing 4 having a contact housing cavity 6. The contact housing cavity 6 is surrounded by a contact housing wall 8 that defines the cavity. The contact housing wall 8 has an inside wall surface 10 and an outside wall surface 12. The contact housing outside wall surface 12 may be formed with a set of male threads 14. The threads 14 are arranged to threadably couple to female threads on a counterpart electrical connector, such as the connector "B" shown in FIG. 1. The connector coupling operation may be performed in the usual manner, such as by rotating the upper ring on the electrical connector "B", the inside of which is formed with female threads.

As best shown in FIG. 5, the contact housing 4 may include a contact housing base 16 from which the contact housing wall 8 extends to define the contact housing cavity 6. A central portion 16A of the contact housing base 16 closes the bottom base end of the contact housing cavity 6. The upper end of the contact housing cavity 6 is open. The contact housing wall 8 has a base end 18 where it meets the contact housing base 16, and a contact housing wall free end 20 that is remote from the contact housing base. As shown in FIG. 4, the contact housing wall 8 has a wall thickness "t" at the contact housing wall free end 20. The contact housing wall thickness "t" represents the distance between the contact housing inside and outside wall surfaces 10 and 12. The contact housing wall free end 20 defines a contact housing wall free end surface 20A that spans the contact housing wall thickness dimension "t."

The central portion 16A of the contact housing base 16, which closes the bottom of the contact housing cavity 6, supports two or more electrical contacts 22 that are disposed in the contact housing cavity. Although four such electrical contacts 22 are shown in the drawing figures, this is for purposes of example only. In the illustrated embodiment, the electrical contacts 22 are formed as elongated pins that extend through openings 24 formed in the central base portion 16A (see FIG. 5). Because the contact housing 4 is metal, the electrical contacts 22 are insulated by a dielectric material 26 (see FIG. 5) that surrounds the electrical contacts within the openings 24. Although not shown, the electrical contacts 22 may extend below the central base portion 16A, where they may be connected to the electrical leads of a cable (not shown) that exits from the bottom of the contact housing 4. If desired, a lower generally tubular portion 16B of the contact housing base 16 may be optionally provided in order to mount the electrical connector 2 to the cable.

As best shown in FIG. 4, the contact housing 4, and in particular the contact housing cavity 6 and the contact housing wall 8, are substantially circular in shape when viewed in plan view orientation. Three-dimensionally, the contact housing wall 8 is substantially tubular, save for the threads 14 formed on its outside wall surface 12. The contact housing cavity 6 has a center point (and longitudinal "z" axis) designated by the notation "Co." The center point "Co" lies at the intersection of an "x" axis 28A and a "y" axis 28B of the contact housing 4. It will be seen from FIG. 1 that the counterpart electrical connector "B," to which the electrical connector 2 may be configured to mate, has a corresponding circular configuration. It will also be observed that the electrical contacts 22 are arranged in a square pattern of electrical contact pins, and that the counterpart electrical connector "B" has a corresponding square pattern of electrical contact pin receptacles that receive the electrical contact pins to establish electrical connections.

It will be appreciated from the foregoing that the electrical connector 2 must be rotationally aligned in a predetermined manner with the counterpart electrical connector "B," such that each electrical contact 22 engages only a corresponding one of the electrical contact receptacles. Otherwise the electrical connections will not be properly polarized. For the electrical connector 2, there are four possible rotational alignment positions spaced 90 degrees apart. Only one such alignment position is the correct one.

To ensure proper alignment and electrical polarization, the electrical connector 2 is provided with a polarization alignment key 30 disposed on the inside surface 10 of the contact housing wall 8. The key 30 is operable to engage a polarization alignment keyway in the counterpart electrical connector "B" of FIG. 1 during mating of the electrical connectors to form an electrical connector pair. Unlike the electrical connector "A" of FIG. 1, the key 30 is mounted to the contact housing wall 8 in a manner that is quite different than the prior art key-mounting technique described in the "Background" section above.

To facilitate mounting of the key 30, a key-retaining pocket 32 is formed in the contact housing wall 8. The key-retaining pocket is positioned relative to the center point Co of the contact housing cavity 6 so that it intersects the inside surface 10 of the contact housing wall 8. This forms a longitudinal slot 34 (best shown in FIGS. 3 and 4) between the key-retaining pocket 32 and the contact housing cavity 6. The key-retaining pocket 32 may be formed as a bore that starts at the free end 20 of the contact housing wall 8 (at the free end surface 20A) and extends toward the base end 18 of the contact housing wall 8. The key-retaining pocket 32 is oriented in a direction that is substantially parallel to the contact housing cavity's central longitudinal axis. The length of the key-retaining pocket 32, and correspondingly the longitudinal slot 34, is sufficient to accommodate the length of the key 30.

The key 30 is mounted on the contact housing 4 by virtue of a portion thereof being disposed in the key-retaining pocket 32. To that end, the key 30 may be configured to include a key base portion 36 that is configured to be received in the key-retaining pocket 32. The key base portion 36 may be retained in the key-retaining pocket 32 by press-fitting or the like. The key 30 may further include a key stem portion 38 extending through the longitudinal slot opening 34 into the contact housing cavity 6. The key stem portion 38 extends lengthwise substantially parallel to the contact housing cavity's central longitudinal axis. It is the key stem portion 38 that engages the corresponding keyway in the counterpart electrical connector "B" of FIG. 1.

In the illustrated embodiment, the key-retaining pocket 32 is substantially circular in cross-section, and the key base portion 36 has a matching substantially cylindrical surface 36A (see FIG. 4) that engages the walls of the key-retaining pocket. Other cross-sectional shapes could also be used. As additionally shown in FIG. 4, the key stem portion 38 includes a pair of side surfaces 38A that define a width dimension "w" of the stem portion. The side surfaces 38A of the key stem portion 38 intersect the cylindrical surface of the key base portion 36 at two locations to define concave longitudinal elbows 40. The longitudinal elbows 40 engage the two opposing sides of the longitudinal slot opening 34. The width "w" of the key stem portion 38 thus completely spans the width of the longitudinal slot opening 34. This prevents rotation of the key 30 in the key-retaining pocket 32.

Turning now to FIGS. 6A-6G, an example method for manufacturing the electrical connector 2 will now be described. For ease of illustration, FIGS. 6A-6G only show the formation of the upper portion of the contact housing 4, which is the portion that includes the contact housing wall 8 and the central portion 16A of the contact housing base 16. The formation of the optional lower portion 16B of the contact housing base 16 is not depicted.

Figure 6A:
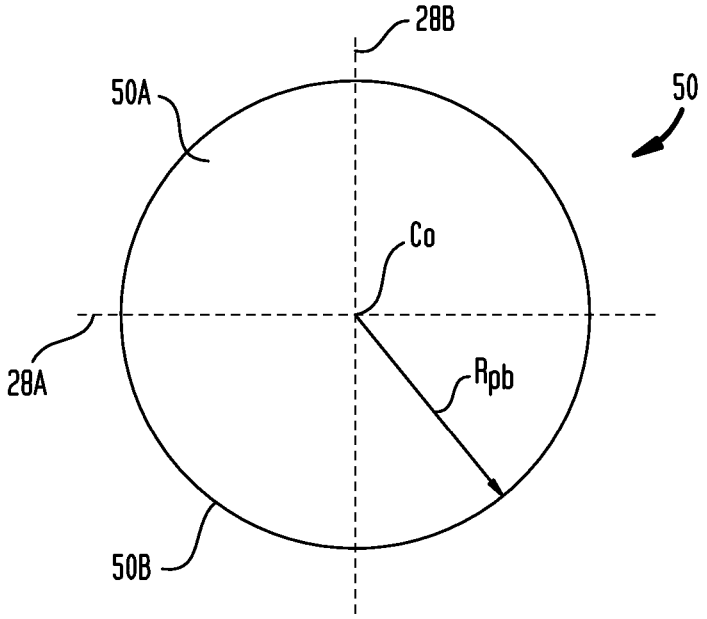
FIG. 6A is a top plan view showing a first stage of formation of the electrical connector of FIG. 3 according to an example manufacturing method.

Beginning in FIG. 6A, manufacturing may begin with the selection of a machinable blank 50 whose upper portion will be used to form the aforesaid upper portion of the contact housing 4. The machinable blank 50 is made from a suitable metal material, such as aluminum. It may be initially constituted as a metal block that has been machined or otherwise formed into the shape of a right cylinder. The machinable blank 50 has the same center point (and longitudinal "z" axis) "Co" as the contact housing 4. Thus, the center point Co lies at the intersection of the contact housing's "x" axis 28A and "y" axis 28B.

The machinable blank 50 has an upper face 50A, an outer part blank surface 50B having a defined radius "Rpb," and a selected length. The radius Rbp of the machinable blank 50 may initially be larger than the width of the contact housing 4 to be formed from the blank, and then subsequently machined and tapped to respectively provide the outside wall surface 12 of the contact housing wall 8 and the threads 14. Alternatively, the radius Rpb could be selected to exactly coincide with the final width of the contact housing 4. The width of the contact housing wall is given by the radius of the outside wall surface 12 (which shall be designated "Ro") plus the height of the threads 14 (which shall be designated "H"). An example size range of the part blank radius Rpb is thus given by equation (1) below:

$$Rpb \geq Ro+H \quad (1)$$

The length of the machinable blank 50, or at least the portion shown in FIGS. 6A-6G, extends from the upper face 50A to a lower region of the machinable blank that is not shown in the drawing figures. The length of the machinable blank 50 is selected to provide the full height of the contact housing wall 8, from its base end 18 to its free end 20, as well as at least the upper region of the contact housing base 16 that includes the central portion 16A. In most cases, however, the machinable blank will be of sufficient size to fabricate the entire electrical connector 2, including the lower portion 16B of the contact housing base (if present). Although not shown, it will be appreciated that machinable blanks with non-cylindrical shapes could also be used, particularly if the contact housing 4 is non-cylindrical.

Figure 6B:
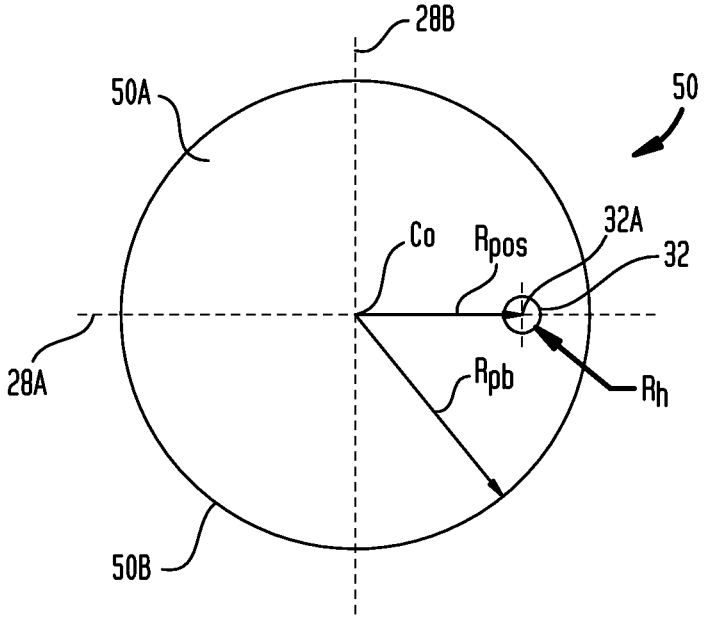
FIG. 6B is a top plan view showing a second stage of formation of the electrical connector of FIG. 3 according to an example manufacturing method.

As shown in FIG. 6B, the key-retaining pocket 32 of the electrical connector 2 may next be formed in the machinable blank 50. This may be done by forming a circular hole in the upper face 50A of the machinable blank 50, the length of the hole corresponding to the desired length of the key-retaining pocket 32. As described in more detail below, the distance from the center Co of the machinable blank 50 to the center point 32A of the key-retaining pocket 32 (which shall be designated "Rpos") is selected according to the desired size of the contact housing cavity 6. As also described in more detail below, the diameter of the key-retaining pocket 32 (which shall be designated "Rh") is selected according to the thickness t of the contact housing wall 8.

Figure 6C:
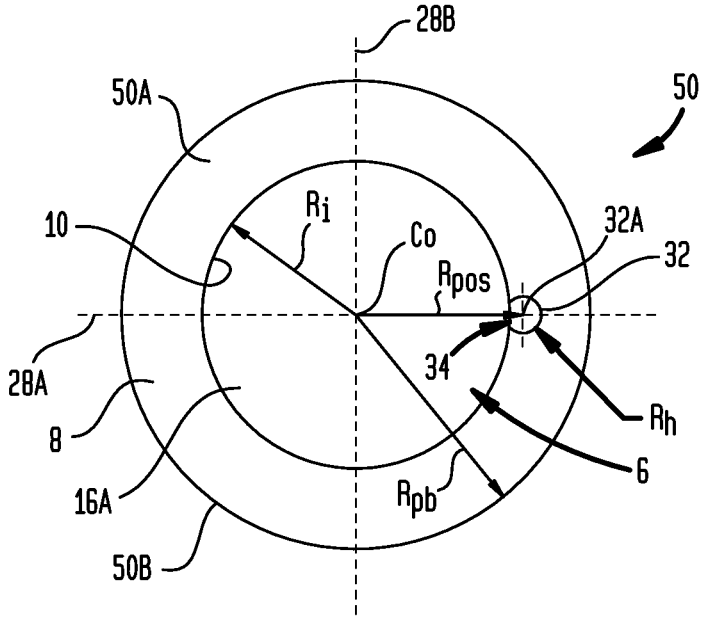
FIG. 6C is a top plan view showing a third stage of formation of the electrical connector of FIG. 3 according to an example manufacturing method.

As shown in FIG. 6C, the contact housing cavity 6 of the electrical connector 2 may next be formed in the machinable blank 50. This may be done by forming a circular hole in the upper end face 50A of the machinable blank 50, centered at the center point Co. This hole has a radius "Ri" that defines the inside wall surface 10 of the contact housing wall 8. The length of the hole corresponds to the desired depth of the contact housing cavity 6, and thus extends to the central base portion 16A that closes the bottom of the cavity. It will be seen that the edge of the contact housing cavity 6 intersects the key-retaining pocket 32 to form the longitudinal slot 34. The radius Ri of the contact housing cavity is thus less than the radius Rpos of the center point 32A of the key-retaining pocket 32. This means that the arc spanned by the side wall of the key-retaining pocket 32 (i.e., between the two edges of the longitudinal slot opening 34) is greater than 180°, thereby ensuring that the key 30 will be properly retained.

Figure 6D:
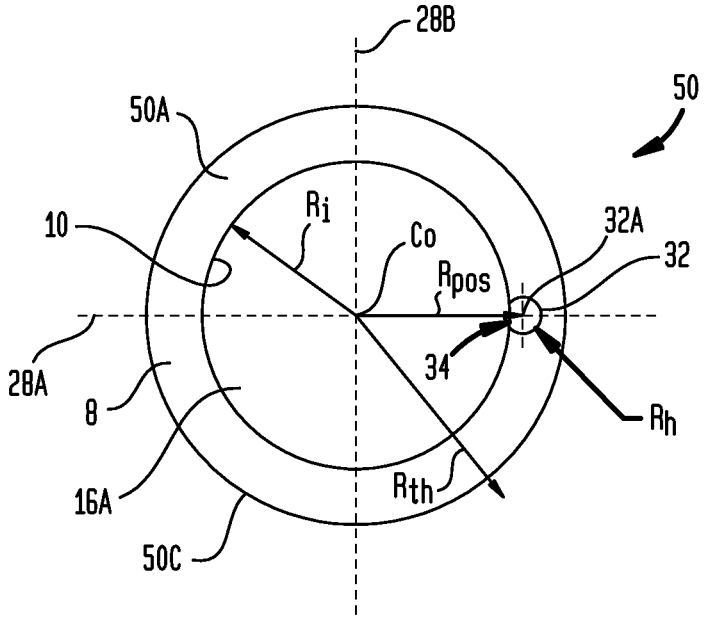
FIG. 6D is a top plan view showing a fourth stage of formation of the electrical connector of FIG. 3 according to an example manufacturing method.

As shown in FIG. 6D, the machinable blank's outside surface 50B shown in FIGS. 6A-6C has been optionally machined to defined a new surface 50C whose radius "Rth" corresponds to the radius of the outside wall surface 12 of the contact housing wall 8 plus the height of the threads 14. It will be appreciated that this step is not required if the original surface 50B at the part blank radius Rpb already corresponds to the thread height radius Rth.

Figure 6E:
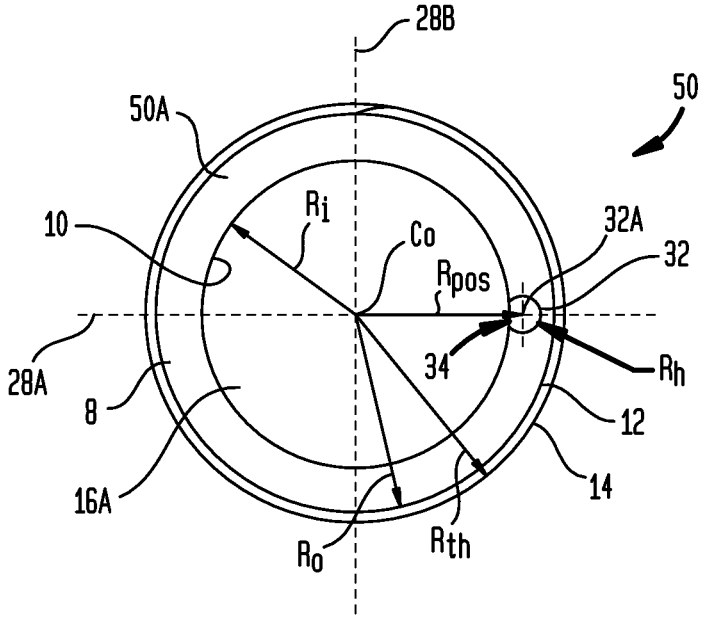
FIG. 6E is a top plan view showing a fifth stage of formation of the electrical connector of FIG. 3 according to an example manufacturing method.

As shown in FIG. 6E, the machinable blank's reduced-radius outside surface 50C has been tapped over a portion of its length to form the threads 14 and the outside wall surface 12 of the contact housing wall 8. At this point, the wall thickness t of the contact housing wall 8 has been defined. It is the distance from the radius Ri of the inside wall surface 10 to a radius Ro of the outside wall surface 12 (which is the same radius as the base of the threads 14).

Figure 6F:
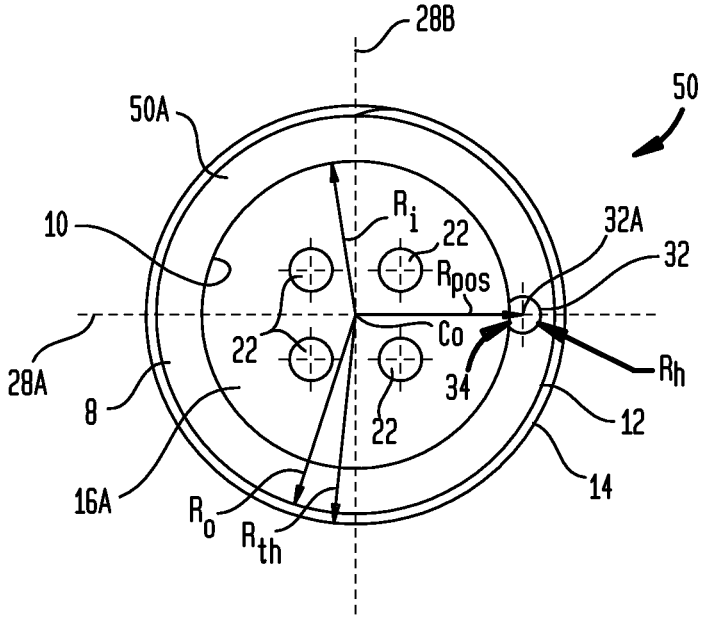
FIG. 6F is a top plan view showing a sixth stage formation of the electrical connector of FIG. 3 according to an example manufacturing method.

In FIG. 6F, four holes have been drilled to form the openings 24 for the electrical contacts 22.

Figure 6G:
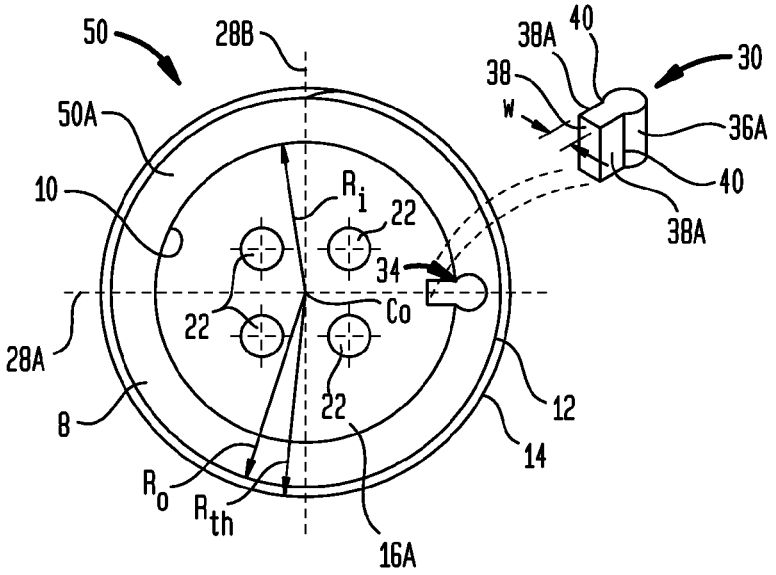
FIG. 6G is a top plan view showing a seventh stage of formation of the electrical connector of FIG. 3 according to an example manufacturing method.

In FIG. 6G, the key 30 has been formed and is mounted by press-fitting its base portion 36A into the key-retaining pocket 32. Various techniques may be used to fabricate the key 30, including electrical discharge machining (EDM), the latter technique being advantageous due to the fact that the key will typically be quite small in size. Although not shown, the electrical contacts 22 may be mounted in their openings 24 at this point, and the insulative dielectric material 26 may be added.

As best shown in FIG. 6F, several preferential relationships may now be described with respect to the size and position of the key-retaining pocket 32, the contact housing cavity 6, and the contact housing wall 8. As previously mentioned, it is desirable that the radius Rpos to the center point 32A of the key-retaining pocket 32 be selected so that the inside wall surface 10 of the contact housing wall 8 intersects the key-retaining pocket. The point of intersection should a location that allows the arc spanned by the side wall of the key-retaining pocket 32 (i.e., between the two edges of the longitudinal slot opening 34) to be greater than 180°, thereby ensuring that the key 30 will be properly retained. This means that the center point radius Rpos of the key-retaining pocket 32 must be larger than the radius Ri of the inside wall surface 10 of the contact housing wall 8. In other words, it must be larger than 0% of the distance from the inside wall surface 10 to the outside wall surface 12 of the contact housing wall 8. On the other hand, the center point radius Rpos of the key-retaining pocket 32 must be smaller the 50% of the distance from the inside wall surface 10 to the outside wall surface 12 of the contact housing wall 8. Otherwise, depending of the size Rh of the key-retaining pocket 32, its inside edge would either not intersect the inside wall surface 10 (if the key-retaining pocket is small), or its outside edge would intersect the outside wall surface 12 (if the key-retaining pocket is large).

The foregoing positional constraints of the key-retaining pocket are given by equation (2) below:

$$Ri < Rpos < [(Ro-Ri)/2] \quad (2)$$

The key-retaining pocket 32 must be sufficiently large to accommodate the base portion 36A of the key 32 and to also ensure that the width w of the key's stem portion 38 is wide enough for the end-use application of the electrical connector 2. At the same time, the key-retaining pocket 32 must be sufficiently small to provide adequate clearance between the pocket and the outside wall surface 12 of the contact housing wall 8. Applicant's have found that a suitable size for the key-retaining pocket 32 when its radius Rh is between approximately 40-45% of the contact housing wall thickness t. This size suggestion is given by equation (3) below:

$$Rh=(0.4 \ldots 0.45)\times(Ro-Ri) \quad (3)$$

Applicant's have found that when the key-retaining pocket 32 is sized in accordance with the above, a suitable radial position Rpos for the center point 32A is approximately 25% of the distance from the inside surface 10 of the contact housing wall to the outside surface 12 of the contact housing wall. This is given by equation (4) below:

$$Rpos>=Ri+[(Ro-Ri/4)]$$

Accordingly, an electrical connector and manufacturing method have been disclosed. Although various example embodiments have been shown and described, it should be apparent that many variations and alternative embodiments could be implemented in accordance with the disclosure. For example, although the contact housing 4, and particularly the contact housing wall 8, are shown to have a circular configuration, non-circular configurations could also be used (e.g., elliptical, square, rectangular, etc.). Moreover, although the electrical connector 2 is shown to have electrical contacts 22 formed as pins, the electrical contacts formed as pin receptacles could be provided. Different pin patterns, e.g. circular, semi circular, rectangular, elliptical, triangular, could also be used.

It is understood, therefore, that the invention is not to be in any way limited except in accordance with the spirit of the appended claims and their equivalents.

What is claimed is:

1. An electrical connector, comprising:

a machined metal contact housing having a contact housing cavity surrounded by a contact housing wall, wherein said contact housing comprises a contact housing base and said contact housing wall extends from said contact housing base to define said contact housing cavity, said contact housing cavity having a central longitudinal axis;

two or more electrical contacts disposed in said contact housing cavity;

a polarization alignment key disposed on an inside surface of said contact housing wall, said key being operable to engage a polarization alignment keyway during mating of said electrical connector with a counterpart electrical connector to form an electrical connector pair;

a key-retaining pocket formed in said contact housing wall intersects an inside surface of said contact housing wall to form a longitudinal slot opening between said key-retaining pocket and said contact housing cavity; and said key being mounted on said contact housing by virtue of a portion thereof being disposed in said key-retaining pocket.

2. The electrical connector of claim 1, wherein said contact housing wall comprises a contact housing outside wall surface, said contact housing inside wall surface, a contact housing thickness dimension between said contact housing outside and inside wall surfaces, a contact housing wall base end at said contact housing base, and a contact housing wall free end remote from said contact housing base.

3. The electrical connector of claim 2, wherein said contact housing wall free end comprises a contact housing wall free end surface defined by said contact housing wall thickness dimension.

4. The electrical connector of claim 3, wherein said two or more electrical contacts are disposed on said contact housing base within said contact housing cavity.

5. The electrical connector of claim 4, wherein said key-retaining pocket extends from said contact housing wall free end toward said contact housing wall base end in a direction that is substantially parallel to said contact housing cavity central longitudinal axis.

6. The electrical connector of claim 5, wherein a longitudinal side portion of said key-retaining pocket intersects said contact housing wall inside surface to form said longitudinal slot opening along a length of said key-retaining pocket.

7. The electrical connector of claim 6, wherein said key comprises a key base portion retained in said key-retaining pocket and a key stem portion extending through said longitudinal slot opening into said contact housing cavity.

8. The electrical connector of claim 7, wherein said key stem portion extends lengthwise substantially parallel to said contact housing cavity central longitudinal axis.

9. The electrical connector of claim 8, wherein said key-retaining pocket is substantially circular.

10. The electrical connector of claim 9, wherein said contact housing cavity is substantially circular and said contact housing wall is substantially tubular.

11. The electrical connector of claim 10, wherein said key base portion comprises a substantially cylindrical surface that engages said key-retaining pocket, and wherein said key stem portion comprises a pair of side surfaces that intersect said cylindrical surface at two locations that define concave longitudinal elbows engaging two sides of said longitudinal slot opening, said key stem portion completely spanning said longitudinal slot opening in order to prevent rotation of said key in said key-retaining pocket.

12. The electrical connector of claim 11, wherein said key-retaining pocket is centered at a position that is greater than approximately 0% and less than approximately 50% of a distance from said contact housing inside wall surface to said contact housing outside wall surface.

13. The electrical connector of claim 12, wherein said key-retaining pocket has a radius that is between approximately 40-45% of said contact housing wall thickness.

14. The electrical connector of claim 13, wherein said key-retaining pocket has a radius that is between approximately 40-45% of said contact housing wall thickness, and wherein said key-retaining pocket is centered at a position that is approximately 25% of a distance from said contact housing inside wall surface to said contact housing outside wall surface.

15. A method for manufacturing the electrical connector of claim 1, comprising:

machining said key-retaining pocket in a metal blank from which said contact housing will be formed;

machining said contact housing cavity in said blank so as to intersect said key-retaining pocket and form said longitudinal slot opening between said key-retaining pocket and said contact housing cavity;

forming said key so as to provide said key portion that is disposed in said key-retaining pocket;

mounting said key to said contact housing by pressing said key portion into said key-retaining pocket; and mounting said two or more electrical contacts in said contact housing cavity.

16. The method of claim 15, further including machining an exterior surface of said blank to provide said contact housing wall with a selected contact housing wall thickness.

17. The method of claim 16, wherein said blank is substantially shaped as a right cylinder having a defined radius and a length, and wherein said key-retaining pocket and said contact housing cavity are substantially circular.

18. The method of claim 17, wherein said key-retaining pocket has a radius that is between approximately 40-45% of said contact housing wall thickness, and wherein said key-retaining pocket is centered at a position that is approximately 25% of a distance from said contact housing inside wall surface to said contact housing outside wall surface.

19. An electrical connector, comprising:

a machined metal contact housing having a contact housing base and a contact housing wall extending from said contact housing base to define a contact housing cavity having a central longitudinal axis oriented substantially perpendicular to said contact housing base;

said contact housing wall having a contact housing outside wall surface, a contact housing inside wall surface, a contact housing thickness dimension between said contact housing outside and inside wall surfaces, a contact housing wall base end at said contact housing base, and a contact housing wall free end remote from said contact housing base;

said contact housing wall free end having a contact housing wall free end surface defined by said contact housing wall thickness dimension;

two or more electrical contacts disposed on said contact housing base within said contact housing cavity;

a key-retaining pocket in said contact housing wall, said key-retaining pocket extending from said contact housing wall free end toward said contact housing wall base end in a direction that is substantially parallel to said contact housing cavity central longitudinal axis;

a longitudinal side portion of said key-retaining pocket intersecting said contact housing wall inside surface to form a longitudinal slot opening along a length of said key-retaining pocket;

a key having a key base portion retained in said key-retaining pocket and a key stem portion extending through said longitudinal slot opening into said contact housing cavity; and said key stem portion extending substantially parallel to said contact housing cavity central longitudinal opening and being configured to engage a keyway in a mating electrical connector to form an electrical connector pair.

* * * * *